US011269265B2

(12) United States Patent
Fujisawa et al.

(10) Patent No.: US 11,269,265 B2
(45) Date of Patent: Mar. 8, 2022

(54) DEVELOPING ROLLER

(71) Applicant: BRIDGESTONE CORPORATION, Tokyo (JP)

(72) Inventors: Yusuke Fujisawa, Tokyo (JP); Sotaro Yamashita, Tokyo (JP)

(73) Assignee: BRIDGESTONE CORPORATION, Tokyo (JP)

( * ) Notice: Subject to any disclaimer, the term of this patent is extended or adjusted under 35 U.S.C. 154(b) by 0 days.

(21) Appl. No.: 17/024,696

(22) Filed: Sep. 18, 2020

(65) Prior Publication Data

US 2021/0088930 A1 Mar. 25, 2021

(30) Foreign Application Priority Data

Sep. 20, 2019 (JP) ..... JP2019-172233

(51) Int. Cl.
*G03G 15/08* (2006.01)

(52) U.S. Cl.
CPC ..... *G03G 15/0818* (2013.01)

(58) Field of Classification Search
None
See application file for complete search history.

(56) References Cited

U.S. PATENT DOCUMENTS 9,921,518 B2 3/2018 Sakurai et al.
2001/0026708 A1* 10/2001 Ishii ..... G03G 9/0827 399/159

FOREIGN PATENT DOCUMENTS

| | | | |
|---|---|---|---|
| JP | 2012103581 | A | 5/2012 |
| JP | 2013213142 | A | 10/2013 |
| JP | 2017156745 | A | 9/2017 |
| JP | 2018112640 | A | 7/2018 |

* cited by examiner

*Primary Examiner* — Jas A Sanghera
(74) *Attorney, Agent, or Firm* — Kenja IP Law PC

(57) ABSTRACT

Provided are a developing roller which includes a shaft, and a base layer and a surface layer sequentially formed on an outer peripheral portion of the shaft in a radial direction, where 1) a low-resilience layer is disposed between the base layer and the surface layer, 2) the low-resilience layer has a loss tangent tan δ value that is larger than a loss tangent tan δ value of any of the base layer and the surface layer when measured under conditions of a temperature of 23° C., an amplitude of ±20 μm, and a frequency of 6 Hz, and 3) the developing roller has an Asker C hardness and thickness value of 500 or less, which is defined by the following formula (1):

Asker *C* hardness and thickness value of the developing roller=Asker *C* hardness of the developing roller×(thickness of the developing roller+6) (1).

20 Claims, 3 Drawing Sheets

DEVELOPING ROLLER

TECHNICAL FIELD

This disclosure relates to a developing roller.

BACKGROUND

In an image forming apparatus typified by a copying machine, a laser beam printer or the like, image forming and printing is performed by the following series of processes, and the series of processes are repeated in a cycle:

1) the surface of a photoconductor is uniformly charged (charging);

2) the image of a subject is read by an optical system, the image information is projected as light on the photoconductor (exposure), and a latent image is formed by erasing the electric charges of the light-exposed portion of the photoconductor (electrostatic latent image formation);

3) toner is adhered to the photoconductor on which an electrostatic latent image has been formed, and a toner image is formed from the electrostatic latent image (development);

4) the toner image is overlaid on a recording medium such as paper and fixed (transcription and fixation);

5) the toner remaining on the photoconductor is removed (photoconductor cleaning); and 6) all the electric charges on the surface of the photoconductor is removed (static elimination).

In the series of image forming and printing processes, the process of "development" will be described in more detail with reference to FIG. 1. Toner 24, which is a coloring material in image forming technology, is supplied from a toner storage portion 21 to the surface of a developing roller 26 by a toner supply roller 25, and the toner 24 is formed into a uniform thin layer on the surface of the developing roller 26 and triboelectrically charged through a layer-forming blade 27. Then, the toner 24, which is in a uniform thin layer and has been triboelectrically charged, is conveyed to a photoconductor 23 by the developing roller 26 and adhered to an electrostatic latent image held on the surface of the photoconductor 23 to form a toner image.

The toner on the surface of the developing roller 26 is usually physically damaged (toner damage usually occurs) in the situation where the toner 24 is formed into a uniform thin layer and triboelectrically charged on the surface of the developing roller 26 through the layer-forming blade 27, due to a stress generated between the layer-forming blade 27 and the developing roller 26 for this purpose, or in the situation where the toner 24 is conveyed to the photoconductor 23 by the developing roller 26 and adhered to the electrostatic latent image held on the surface of the photoconductor 23 to form a toner image, due to a stress generated between the photoconductor 23 and the developing roller 26 for this purpose. The toner damage causes the formation of filming and toner mass or the like due to toner charging failure, toner adhesion failure, and toner melting and sticking, all of which result in an excessive increase in the amount of toner conveyed by the developing roller, leading to a problem of deterioration in image forming and printing quality. Particularly in recent years, there has been an increasing demand for image forming apparatus in terms of, for example, high speed, improvement of image fineness, and color imaging, and the excessive increase in the amount of toner conveyed by the developing roller caused by the toner damage has become an increasingly serious problem.

Under such circumstances, it is required to suppress the toner damage to obtain stable and good image forming and printing quality in a long period of time, and the toner is being improved. The design concept of the developing roller, as an aspect of solution, is also important.

SUMMARY

It could thus be helpful to provide a developing roller in which toner damage caused by stresses respectively generated between a layer-forming blade and the developing roller and between a photoconductor and the developing roller is reduced, and as a result, an excessive increase in the toner conveyance amount during printing due to over-time use is suppressed. In addition, it could thus be helpful to provide an image forming apparatus using the developing roller.

We have made various studies on the design of each layer of a developing roller, which includes a shaft, and a base layer and a surface layer sequentially formed on an outer peripheral portion of the shaft in a radial direction, to solve the above problem. As a result, we discovered that an excessive increase in the toner conveyance amount during printing due to over-time use can be suppressed in a developing roller where 1) a low-resilience layer is disposed between the base layer and the surface layer, 2) the low-resilience layer has a loss tangent tan δ value that is larger than a loss tangent tan δ value of any of the base layer and the surface layer, and 3) the developing roller has an Asker C hardness and thickness value of 500 or less. The present disclosure is based on the discovery.

That is, the developing roller of the present disclosure is 1. a developing roller comprising a shaft, and a base layer and a surface layer sequentially formed on an outer peripheral portion of the shaft in a radial direction, wherein 1) a low-resilience layer is disposed between the base layer and the surface layer, 2) the low-resilience layer has a loss tangent tan δ value that is larger than a loss tangent tan δ value of any of the base layer and the surface layer when measured under conditions of a temperature of 23° C., an amplitude of ±20 μm, and a frequency of 6 Hz, and 3) the developing roller has an Asker C hardness and thickness value of 500 or less, which is defined by the following formula (1):

$$\text{Asker } C \text{ hardness and thickness value of developing roller} = \text{Asker } C \text{ hardness of developing roller} \times (\text{thickness of developing roller} + 6) \quad (1)$$

where the Asker C hardness of developing roller is a value measured under a load of 1 kg, and the thickness of developing roller is a distance from a surface of the shaft of the developing roller to a surface of the surface layer in the radial direction of the shaft in unit of mm.

Because the developing roller has low resilience and low hardness, the toner damage caused by the stresses respectively generated between the layer-forming blade and the developing roller and between the photoconductor and the developing roller is reduced. As a result, an excessive increase in the toner conveyance amount is suppressed.

In addition, the developing roller of the present disclosure is preferably 2. the developing roller according to 1., wherein the developing roller has a CIT creep rate of 5.0% or more.

Because the developing roller has lower resilience and lower hardness, the toner damage caused by the stresses respectively generated between the layer-forming blade and the developing roller and between the photoconductor and the developing roller is further reduced. As a result, an excessive increase in the toner conveyance amount is further suppressed.

In addition, the developing roller of the present disclosure is preferably 3. the developing roller according to 1. or 2., wherein the low-resilience layer contains an aqueous urethane resin.

The aqueous urethane resin is easier to achieve low resilience by increasing its loss tangent tan δ value, and the aqueous urethane resin has lower hardness. Therefore, the toner damage caused by the stresses respectively generated between the layer-forming blade and the developing roller and between the photoconductor and the developing roller is further reduced. As a result, an excessive increase in the toner conveyance amount is further suppressed. In addition, such a developing roller is easy to produce and environmentally friendly, and can be produced at low costs.

In addition, the developing roller of the present disclosure is preferably 4. the developing roller according to any one of 1. to 3., wherein the surface layer contains urethane resin particles.

The developing roller has an uneven structure formed to enhance the adhesive property of the toner to the surface of the developing roller and to ensure a space between the surface of the developing roller and the layer-forming blade, and has lower hardness. The toner damage caused by the stresses respectively generated between the layer-forming blade and the developing roller and between the photoconductor and the developing roller is further reduced. As a result, an excessive increase in the toner conveyance amount is further suppressed.

In addition, the developing roller of the present disclosure is preferably 5. the developing roller according to any one of 1. to 4., wherein the low-resilience layer has a thickness of 40 μm or more.

Because the developing roller has lower resilience and lower hardness, the toner damage caused by the stresses respectively generated between the layer-forming blade and the developing roller and between the photoconductor and the developing roller is further reduced. As a result, an excessive increase in the toner conveyance amount is further suppressed.

In addition, the image forming apparatus of the present disclosure is 6. an image forming apparatus using the developing roller according to any one of 1. to 5.

The image forming apparatus has good image forming and printing quality, and the good state continues for a longer period of time.

The present disclosure provides a developing roller in which the resilience and the hardness of the developing roller are lowered to reduce toner damage caused by stresses respectively generated between a layer-forming blade and the developing roller and between a photoconductor and the developing roller, and as a result, an excessive increase in the toner conveyance amount during printing due to overtime use is suppressed. In addition, the present disclosure also provides an image forming apparatus using the developing roller.

1 shaft;
2 base layer;
3 intermediate layer;
4 low-resilience layer;
5 surface layer;
6 surface layer-forming resin;
7 surface layer fine particle;
21 toner storage portion;
23 photoconductor;
24 toner;
25 toner supply roller;
26 developing roller;
27 layer-forming blade;
40 conventional developing roller;
41 toner which has been greatly damaged;
42 developing roller of the present disclosure;
43 toner in which toner damage has been suppressed.

DETAILED DESCRIPTION

The following describes the embodiments of the present disclosure in detail. The descriptions are illustrative purposes only and are not to be construed to limit the scope of the present disclosure.

The following describes each component of the developing roller of the present disclosure.

Figure 2:
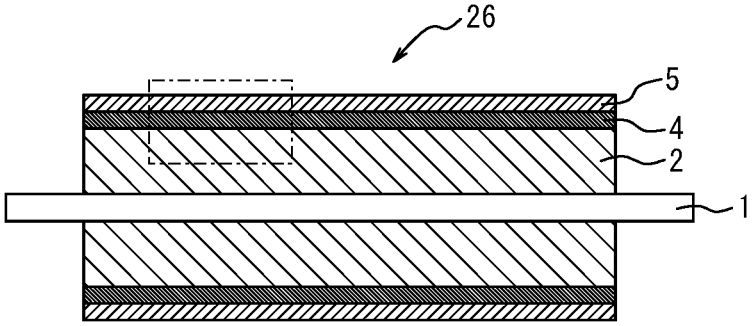
FIG. 2 is a cross-sectional view schematically illustrating an embodiment of the developing roller of the present disclosure.

The structure of the developing roller of the present disclosure is as illustrated in FIG. 2, which is an embodiment of the developing roller of the present disclosure. The developing roller 26 includes a shaft 1, and a base layer 2 and a surface layer 5 sequentially formed on an outer peripheral portion of the shaft in a radial direction, where a low-resilience layer 4 is disposed between the base layer 2 and the surface layer 5.

(Shaft)

The shaft of the developing roller of the present disclosure is not particularly limited as long as it has good conductivity. For example, a metal shaft such as a cored bar made of a solid body of iron, stainless steel, aluminum or other metals, and a metal cylinder having a hollow interior; or a shaft made of highly conductive plastic or the like may be used.

(Base Layer)

The base layer of the developing roller of the present disclosure may typically be a layer closest to the shaft among the layers formed on the outer peripheral portion of the shaft in the radial direction, and may typically be formed on the outer peripheral portion of the shaft in the radial direction so as to be directly adjacent to the shaft. In addition, the base layer of the developing roller of the present disclosure may typically be the thickest layer among the layers formed on the outer peripheral portion of the shaft in the radial direction. The base layer mainly contributes to the shape, elasticity, and hardness of the developing roller.

One important characteristic of the base layer is that it should have a certain elasticity so that the developing roller can obtain a uniform developing nip. From that point of view, the base layer can be formed of a foam. Specifically, it can be formed of an elastomer such as polyurethane, silicone rubber, ethylene-propylene-diene rubber (EPDM), acrylonitrile-butadiene rubber (NBR), natural rubber, styrene-butadiene rubber (SBR), butadiene rubber, isoprene rubber, polynorbornene rubber, butyl rubber, chloroprene rubber, acrylic rubber, epichlorohydrin rubber (ECO), ethylene-vinyl acetate copolymer (EVA), and a mixture thereof, for example.

The base layer of the developing roller of the present disclosure is preferably a low-hardness base layer. This is because, when it is a low-hardness base layer, the Asker C hardness and thickness value of the developing roller described later can be further reduced, and stresses respectively from a photoconductor and a layer-forming blade can be further dispersed. From that point of view, it is preferable to use polyurethane among the above-mentioned elastomers for the base layer of the developing roller of the present disclosure. The foam forming the base layer can be formed by chemically foaming the elastomer with a foaming agent or by mechanically entraining air to foam the elastomer like the case of polyurethane foam. The expansion ratio of the foam forming the base layer is preferably in the range of 1.2 times or more and 50 times or less. This is because, when the expansion ratio is 1.2 times or more, it can be easily taken out of a mold during production; when the expansion ratio is 50 times or less, the diameter of the foam during foaming is stable. Further, the density of the foam forming the base layer is preferably in the range of 0.05 g/cm$^3$ or more and 0.9 g/cm$^3$ or less. This is because, when the density is 0.05 g/cm$^3$ or more, the diameter of the foam during foaming is stable; when the density is 0.9 g/cm$^3$ or less, it can be easily taken out of a mold during production.

In addition, the compression set performance can be improved (that is, it can be easily restored to the original shape even when deformed,) by having closed cells as the cells of the foam forming the base layer. Therefore, the cells in the foam are preferably closed cells. To make the cells of the foam into closed cells, it is preferable to use a method of mechanically stirring the raw material of the elastomer to foam the raw material to obtain a foam.

The base layer can be blended with a conductive agent to adjust the conductivity. Examples of the conductive agent used for the base layer include an electronic conductive agent and an ionic conductive agent. Among these, the blending amount of the electronic conductive agent is preferably 1 part by mass or more and 50 parts by mass or less, and more preferably 5 parts by mass or more and 40 parts by mass or less, with respect to 100 parts by mass of resin components forming the base layer; the blending amount of the ionic conductive agent is preferably 0.01 parts by mass or more and 10 parts by mass or less, and more preferably 0.05 parts by mass or more and 5 parts by mass or less, with respect to 100 parts by mass of resin components forming the base layer. By blending the conductive agent, the resistance of the base layer is preferably $1\times10^3$ Ωcm or more and $1\times10^{10}$ Ωcm or less, and more preferably $1\times10^4$ Ωcm or more and $1\times10^8$ Ωcm or less. This is because, when the resistance of the base layer is $1\times10^3$ Ωcm or more, the risk that electric charges may leak in a photosensitive drum or the like or the developing roller itself may be destroyed by voltage can be reduced; when the resistance of the base layer is $1\times10^{10}$ Ωcm or less, ground fogging is less likely to occur.

If necessary, the base layer may contain a crosslinking agent such as organic peroxide and a vulcanizing agent such as sulfur, or may contain a vulcanizing co-agent, a vulcanization accelerator, a vulcanization acceleration aid, a vulcanization retarder or the like, to make the elastomer into a rubber-like substance. Further, the base layer may contain various rubber compounding agents such as a filler, a peptizer, a foaming agent, a plasticizer, a softener, a tackifier, an anti-tack agent, a separating agent, a release agent, an extending agent, and a coloring agent.

The thickness of the base layer is not limited, yet it is preferably 1 mm or more. This is because, when it is 1 mm or more, sufficient rubber elasticity can be obtained. In addition, it is preferably 3 mm or less. This is because, when it is 3 mm or less, the requirement for small thickness from the viewpoint of cost can be satisfied.

(Surface Layer)

The surface layer of the developing roller of the present disclosure is a layer that forms a surface and is disposed on the outermost side of the developing roller. A surface layer of a developing roller is generally required to control the charging property and adhesive property to toner, reduce the frictional force between the developing roller and the photoconductor, between the developing roller and the layer-forming blade, and the like, and have durability against grinding and wearing and other characteristics. The surface layer of the developing roller of the present disclosure is more preferably a surface layer having low hardness. This is because, when the surface layer has low hardness, the CIT creep rate of the developing roller described later can be further increased, the stresses respectively from the photoconductor and the layer-forming blade can be further reduced, and the toner damage can be further suppressed.

Figure 3:
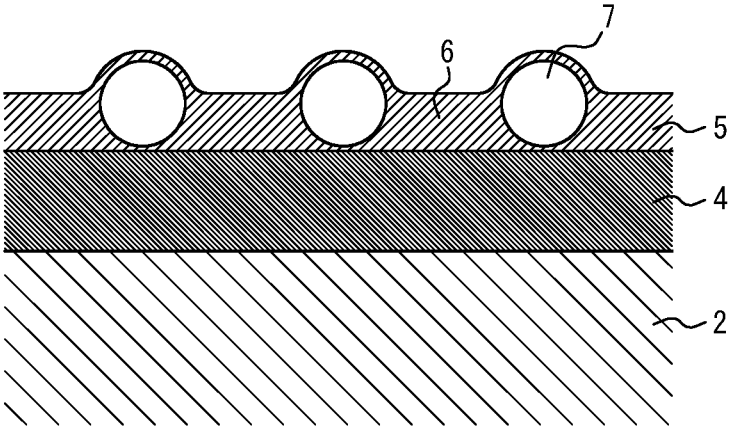
FIG. 3 is an enlarged view of a portion inside the frame of FIG. 2.

The surface layer of the developing roller of the present disclosure will be described with reference to FIG. 3, which is an enlarged view of a portion inside the frame of FIG. 2 schematically illustrating an embodiment of the developing roller of the present disclosure. The developing roller of the present disclosure includes a base layer 2, a low-resilience layer 4 and a surface layer 5, which are laminated in the stated order, where the surface layer 5 is preferably formed using a coating composition containing a surface layer-forming resin 6 as a main component and surface layer fine particles 7 of the resin as a sub-component. By containing the surface layer fine particles 7 of the resin, an uneven structure is formed on the surface layer 5. As a result, a space is secured between the surface of the surface layer of the developing roller and the layer-forming blade, and the adhesive property of toner to the surface of the developing roller is enhanced.

For the surface layer of the developing roller of the present disclosure, the surface layer-forming resin, which is the main component of the coating composition, preferably contains polyol and isocyanate. The glass transition temperature (Tg) of the surface layer-forming resin component is preferably 0° C. or lower and more preferably −10° C. or lower. This is because, by using an aqueous coating containing a resin component having a low Tg, that is, low hardness, it is possible to obtain a high-quality developing roller in which the friction between the formed surface layer and toner is further reduced, and the deterioration of the toner due to the friction is further reduced. However, when the Tg is lower than −20° C., the hardness of the surface is remarkably lowered, and a blade set scar is generated in a high-temperature high-humidity shelf test when assembled with a cartridge, which is undesirable.

Specific examples of the surface layer-forming resin component include a urethane resin obtained by crosslinking a lactone-modified polyol with two or more types of polyisocyanates including at least isophorone diisocyanate, and the urethane resin can be suitable used. The lactone-modified polyol may be produced by modifying the end of polyol with a lactone such as ε-caprolactone, or may be a commercially available product. In addition, from the viewpoint of achieving both compression set performance and toner fusion resistance when applying the lactone-modified polyol to the developing roller, the number-average molecular weight (Mn) in terms of polystyrene of the lactone-modified polyol measured by gel permeation chromatography is preferably 1000 or more and 5000 or less and more preferably 1000 or more and 3000 or less, and the molecular weight distribution (Mw/Mn) represented by a ratio of the weight-average molecular weight (Mw) and the number-average molecular weight (Mn) in terms of polystyrene of the lactone-modified polyol measured by gel permeation chromatography is preferably 2.5 or less and more preferably 2.0 or less.

Examples of the lactone-modified polyol include polyether polyol, polytetramethylene glycol, glycerin, ethylene glycol, propylene glycol, butanediol, pentanediol, hexanediol, octanediol, polybutadiene polyol, polyisoprene polyol, and polyester polyol, which are obtained by addition-polymerizing alkylene oxide such as ethylene oxide or propylene oxide to glycerin or the like.

In addition, the polyisocyanate that crosslinks the lactone-modified polyol is preferably two or more types of polyisocyanates including at least isophorone diisocyanate. By using isophorone diisocyanate, it is possible to improve the toner fusion resistance in long-term use when the coating composition is applied to the developing roller. Examples of the polyisocyanate other than the isophorone diisocyanate (IPDI) in the two or more types of polyisocyanates include tolylene diisocyanate (TDI), diphenylmethane diisocyanate (MDI), crude diphenylmethane diisocyanate (crude MDI), hydrogenated diphenylmethane diisocyanate, hydrogenated tolylene diisocyanate, hexamethylene diisocyanate (HDI), and nurate-modified hexamethylene diisocyanate. From the viewpoint of achieving both low hardness and compression set performance in the surface layer formed of the coating composition, the two or more types of polyisocyanates used for crosslinking the lactone-modified polyol are preferably isophorone diisocyanate and hexamethylene diisocyanate, where the molar ratio of the isophorone diisocyanate to the hexamethylene diisocyanate is more preferably 3:1 to 1:3.

The coating composition may further contain a catalyst to promote the crosslinking reaction between the lactone-modified polyol and the two or more types of polyisocyanates. Examples of the catalyst include organic tin compounds such as dibutyltin dilaurate, dibutyltin diacetate, dibutyltin thiocarboxylate, dibutyltin dimaleate, dioctyltin thiocarboxylate, and tin octenoate; organic lead compounds such as lead octenoate; monoamines such as triethylamine and dimethylcyclohexylamine; diamines such as tetramethylethylenediamine, tetramethylpropanediamine, and tetramethylhexanediamine; triamines such as pentamethyldiethylenetriamine, pentamethyldipropylenetriamine, and tetramethylguanidine; cyclic amines such as triethylenediamine, dimethylpiperazine, methylethylpiperazine, methylmorpholine, dimethylaminoethylmorpholine, and dimethylimidazole; alcohol amines such as dimethylaminoethanol, dimethylaminoethoxyethanol, trimethylaminoethylethanolamine, methylhydroxyethylpiperazine, and hydroxyethylmorpholine; and ether amines such as bis(dimethylaminoethyl) ether, and ethylene glycol bis(dimethyl) aminopropyl ether. Among these catalysts, an organic tin compound is preferred. These catalysts may be used alone or in a combination of two or more. The amount of the catalyst used is preferably in the range of 0.001 parts by mass or more and 2.0 parts by mass or less, with respect to 100 parts by mass of the polyol.

For the surface layer of the developing roller of the present disclosure, the glass transition temperature (Tg) of the surface layer fine particles of the resin, which is the sub-component of the coating composition, is preferably −10° C. or lower, more preferably −13° C. or lower, and still more preferably −30° C. or lower. By containing surface layer fine particles having a low Tg, that is, low hardness, in the coating composition, it is possible to further reduce the friction between the developing roller and other members such as a layer-forming blade, when the coating composition is used to form the surface layer of the developing roller. That is, the softer the surface layer fine particles are, the softer the convex portion in the unevenness on the surface of the developing roller is. As a result, the toner damage can be further reduced when the toner is rubbed between the developing roller and the layer-forming blade. Then, because the toner damage during durable printing can be further reduced, the occurrence of image defects due to the toner fusing on the developing roller and/or the layer-forming blade can be further suppressed.

The surface layer-forming resin component mainly constituting the surface layer is more effective in reducing toner deterioration as the hardness lowers. However, if the surface layer fine particles contained in the surface layer have high hardness, it is ineffective. For the surface layer of the developing roller of the present disclosure, by using a combination of a low-hardness surface layer-forming resin component and low-hardness surface layer fine particles, the effect of reducing toner deterioration can be further improved. For the surface layer of the developing roller of the present disclosure, it is preferable to use, as the surface layer fine particles, low-hardness fine particles having a universal hardness of 2.0 or less, for example, in the range of 0.6 or more and 1.8 or less, at an indentation depth of 1 μm. This is because, when the hardness of the surface layer fine particles is large, the toner damage is large, the toner is crushed between the surface layer fine particles and the photoconductor and between the surface layer fine particles and the layer-forming blade, and the toner is likely to fuse on the blade, thereby causing development streaks. The hardness of the surface layer fine particles is substantially proportional to the Tg value, and the lower the Tg is, the lower the hardness is. Specifically, the hardness is preferably within the above range. As used herein, the universal hardness of the surface layer fine particles can be obtained by measuring the surface layer fine particle portion in the surface layer with a Fischer hardness tester during the formation of the surface layer of the developing roller of the present disclosure.

The material of the surface layer fine particles is not particularly limited as long as it satisfies the above Tg value. For example, a urethane resin having lower hardness than melamine resin, acrylic resin or the like can be suitably used.

In addition, the particle size of the surface layer fine particles is also important. It is preferable to use surface layer fine particles having an average particle size of 10 μm or more. By increasing the particle size of the surface layer fine particles to a certain extent, it is possible to secure more space between the surface of the surface layer of the developing roller and the layer-forming blade. As a result, the toner conveying property is further enhanced and the effect of reducing toner deterioration is further improved. On the other hand, when the particle size of the surface layer fine particles is too large, image distortion occurs. Therefore, it is more preferable to use surface layer fine particles having an average particle size of 10 μm or more and 16 μm or less, and still more preferable to use surface layer fine particles having an average particle size of 12 μm or more and 14 μm or less. By using surface layer fine particles having a particle size of 16 μm or less, it is possible to further suppress the occurrence of image distortion.

The content of the surface layer fine particles is preferably 1.5 parts by mass or more and 6.0 parts by mass or less, and more preferably 2.0 parts by mass or more and 4.5 parts by mass or less, with respect to 100 parts by mass of the polyol component. When the blending amount of the surface layer fine particles is small, the space between the surface layer formed of the coating composition and the layer-forming blade is insufficient. When the blending amount of the surface layer fine particles is large, the influence of the friction between the surface layer fine particles and the toner is large. By setting the blending amount of the surface layer fine particles within the above range, it is possible to obtain a more reliable effect of reducing toner deterioration while ensuring appropriate toner conveying property.

Further, a conductive agent such as an electronic conductive agent or an ionic conductive agent may be added to the coating composition of the surface layer of the developing roller of the present disclosure to adjust the conductivity. Examples of the electronic conductive agent include conductive carbon such as Ketjenblack and acetylene black, carbon black for rubber such as SAF, ISAF, HAF, FEF, GPF, SRF, FT and MT, carbon black for coloring that has been subjected to oxidation treatment or other treatment, pyrolytic carbon black, natural graphite, artificial graphite, metal oxides such as antimony-doped tin oxide, ITO, tin oxide, titanium oxide and zinc oxide, metals such as nickel, copper, silver and germanium, conductive polymers such as polyaniline, polypyrrole and polyacetylene, conductive whiskers such as carbon whisker, graphite whisker, titanium carbide whisker, conductive potassium titanate whisker, conductive barium titanate whisker, conductive titanium oxide whisker, and conductive zinc oxide whisker.

Examples of the ion conductive agent include ammonium salts such as perchlorates, chlorates, hydrochlorides, bromates, iodates, fluoborates, sulfates, ethyl sulfates, carboxylates, sulfonates and the like of tetraethylammonium, tetrabutylammonium, dodecyltrimethylammonium, hexadecyltrimethylammonium, benzyltrimethylammonium, modified fatty acid dimethylethylammonium and the like; and perchlorates, chlorates, hydrochlorides, bromates, iodates, borohydrofluorides, sulfates, trifluoromethyl sulfates, sulfonates of alkali metals and alkaline earth metals such as lithium, sodium, potassium, calcium and magnesium. These conductive agents may be used alone or in a combination of two or more, and the electronic conductive agent and the ionic conductive agent may be used in combination.

In the case of the ionic conductive agent, the blending amount of the conductive agent in the coating composition is preferably 20 parts by mass or less, more preferably in the range of 0.01 parts by mass or more and 20 parts by mass or less, and still more preferably in the range of 1 part by mass or more and 10 parts by mass or less, with respect to 100 parts by mass of the surface layer-forming resin component. On the other hand, in the case of the electronic conductive agent, it is preferably in the range of 1 part by mass or more and 70 parts by mass or less, and more preferably in the range of 5 parts by mass or more and 50 parts by mass or less, with respect to 100 parts by mass of the resin component. By adding the conductive agent, the volume resistance of the layer formed using the coating composition is preferably adjusted to $1\times10^{3}$ Ωcm or more and $1\times10^{10}$ Ωcm or less, and more preferably adjusted to $1\times10^{4}$ Ωcm or more and $1\times10^{8}$ Ωcm or less.

The thickness of the surface layer is not particularly limited, yet it is preferably 30 μm or less, and more preferably 1 μm or more and 15 μm or less. This is because, when the thickness of the surface layer is 30 μm or less, a more appropriate uneven structure can be formed and low hardness that further suppresses the toner damage can be obtained; when the thickness of the surface layer is 1 μm or more, the low hardness and the charging property and adhesive property to toner are further enhanced and the durability of the surface layer is further improved.

(Low-Resilience Layer)

The low-resilience layer of the developing roller of the present disclosure is a layer whose loss tangent tan δ value is larger than the loss tangent tan δ value of any of the base layer and the surface layer when measured under conditions of a temperature of 23° C., an amplitude of ±20 μm, and a frequency of 6 Hz. The low-resilience layer is disposed between the base layer and the surface layer. If the base layer is made to have low resilience, a problem of compression set may occur because the base layer has a corresponding thickness. If the surface layer is made to have low resilience, the surface is highly tacky, and problems such as toner adhesion may occur. Then, by disposing the low-resilience layer between the base layer and the surface layer, it is possible to avoid these problems and, through the low-resilience layer, absorb the impact caused by the stresses respectively generated between the layer-forming blade and the developing roller and between the photoconductor and the developing roller. When the developing roller is introduced with the low-resilience layer, the CIT creep rate is further increased, and the toner damage can be further suppressed.

As used herein, the loss tangent tan δ value is obtained by $$\text{loss tangent } \tan\delta = \text{loss elastic modulus indicating viscosity}/\text{storage elastic modulus indicating elasticity} \quad (2),$$

and it is an index for evaluating which of viscous property and elastic property is stronger during the deformation of a visco-elastic body. For example, the loss tangent tan δ value may be obtained by using a dynamic viscoelasticity measuring device to give a strain that deforms a sample by vertically vibrating a probe to which the sample is fixed so as to give a sinusoidal force to measure the elastic modulus. As used herein, the loss tangent tan δ value is measured with a dynamic viscoelasticity automatic measuring device (RHEOVIBRON DDV-01GP, A&D Company, Limited) under the conditions of a temperature of 23° C., an amplitude of ±20 μm, and a frequency of 6 Hz (frequency calculated from the rotation speed of the developing roller inside a printer used in the measurement).

The low-resilience layer is not particularly limited except that, as its physical properties, the loss tangent tan δ value is larger than the loss tangent tan δ value of any of the base layer and the surface layer, and it has low-resilience properties. However, the low-resilience layer is preferably formed of an aqueous coating. This is because the aqueous coating further increases the loss tangent tan δ value and renders it easier to achieve low resilience, and aqueous coating is environmentally friendly and can form a low-hardness layer more easily at low production costs. The aqueous coating is not particularly limited, and rubber or a resin known as a material for rollers and the like can be used. Examples of the resin include a urethane-modified acrylic resin, a urethane resin, an acrylic resin, an acrylic silicone resin, a polyamide resin, and a fluororesin. These may be used alone or in a combination of two or more. Suitable examples of the rubber-based aqueous coating include latex of natural rubber (NR), chloroprene rubber (CR), nitrile rubber (nitrile butadiene rubber (NBR)), styrene butadiene rubber (SBR) and the like. Suitable examples of the urethane resin-based aqueous coating include an ether-based or ester-based emulsion or dispersion. Suitable examples of the acrylic resin-based aqueous coating include an acrylic or acrylic styrene emulsion or the like. Suitable examples of the fluororesin-based aqueous coating include polytetrafluoroethylene or tetrafluoroethylene-perfluoroalkyl vinyl ether copolymer, tetrafluoroethylene-ethylene copolymer, polychlorotrifluoroethylene, chlorotrifluoroethylene-ethylene copolymer, tetrafluoroethylene-vinylidene fluoride copolymer, polyvinylidene fluoride, and polyvinyl fluoride. Among these, it is preferable to use an aqueous urethane resin for the low-resilience layer of the developing roller of the present disclosure. This is because the aqueous urethane resin further increases the loss tangent tan δ value and renders it easier to achieve low resilience, and additionally, the aqueous urethane resin has more desirable characteristics such as high coatability and low hardness.

The loss tangent tan δ value of the low-resilience layer is not particularly limited as long as it is a value larger than the loss tangent tan δ value of any of the base layer and the surface layer. However, it is preferably 0.5 or more and 0.7 or less. This is because, when the tan δ of the low-resilience layer is 0.5 or more, the stresses respectively from the photoconductor and the layer-forming blade can be absorbed more efficiently; when the tan δ is 0.7 or less, it is possible to have less troublesome handling due to high viscosity during the production. The method of increasing the loss tangent tan δ value is not limited. Examples thereof include reducing the proportion of hard segments in the urethane skeleton consisting of soft segments and hard segments, or introducing a crystalline structure. In addition, the desired loss tangent tan δ value is not limited, and for example, it can be obtained by mixing a material having a low loss tangent tan δ value and a material having a high loss tangent tan δ value and adjusting the mixing ratio.

The aqueous coating forming the low-resilience layer of the developing roller of the present disclosure may be added with a conductive agent to impart or adjust the conductivity (electric resistance), although it is not particularly limited. The conductive agent used in this case is not particularly limited, and various electronic conductive agents and various ionic conductive agents similar to those mentioned above and used for the base layer may be appropriately selected and used alone or in a combination of two or more. The blending amount of these conductive agents is appropriately selected according to the type of the composition, and usually it is adjusted so that the volume resistivity of the low-resilience layer is $1\times10^4$ Ωcm or more and $1\times10^{12}$ Ωcm or less and preferably $1\times10^6$ Ωcm or move and $1\times10^8$ Ωcm or less. In addition, it is possible to further add additives other than the conductive agent such as a filler to the aqueous coating forming the low-resilience layer.

The thickness of the low-resilience layer is preferably 40 μm or more, in order to obtain better other characteristics such as the balance with the required thickness of the intermediate layer described later and the hardness of the developing roller. It is more preferably 50 μm or more and still more preferably 70 μm or more. This is because, when the thickness of the low-resilience layer increases, the stresses respectively generated between the layer-forming blade and the developing roller and between the photoconductor and the developing roller can be further absorbed to further reduce the toner damage, thereby obtaining a developing roller in which an excessive increase in the toner conveyance amount is further suppressed. Further, it is preferably 150 μm or less and more preferably 100 μm or less. This is because, when the thickness of the low-resilience layer is 150 μm or less, it is possible to reduce the risk of occurrence of the problem that the restoration of the shape deformed due to low resilience is poor. In addition, the production costs can be further reduced.

The disposing position of the low-resilience layer is not particularly limited as long as it is disposed between the base layer and the surface layer in the radial direction of the charging roller.

(Intermediate Layer)

Figure 4:
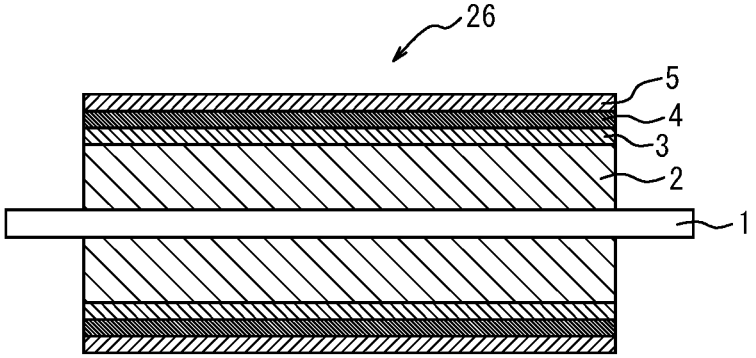
FIG. 4 is a cross-sectional view schematically illustrating another embodiment of the developing roller of the present disclosure.

FIG. 4 illustrates another embodiment of the developing roller of the present disclosure. As illustrated in FIG. 4 the developing roller of the present disclosure may optionally include an intermediate layer 3 as another layer disposed between the base layer 2 and the low-resilience layer 4. In another embodiment, the developing roller of the present disclosure may include two or more intermediate layers as other layers disposed between the base layer 2 and the low-resilience layer 4. In another embodiment, the base layer 2 and the low-resilience layer 4 may be directly adjacent to each other in the developing roller of the present disclosure, without disposing any intermediate layer as another layer between the base layer 2 and the low-resilience layer 4. In another embodiment, the developing roller of the present disclosure may include one or more intermediate layers as other layers disposed between the low-resilience layer 4 and the surface layer 5. In another embodiment, the low-resilience layer 4 and the surface layer 5 may be directly adjacent to each other in the developing roller of the present disclosure, without disposing any intermediate layer as another layer between the low-resilience layer 4 and the surface layer 5. Even in the case where the intermediate layers are disposed, the loss tangent tan δ value of the low-resilience layer is preferably larger than the loss tangent tan δ value of any of the intermediate layers. The intermediate layer may have low hardness for the purpose of lowering the hardness of the developing roller, for example. In this case, the balance between low hardness and low resilience of the developing roller can be further enhanced by adjusting the ratio of the thickness of the low-resilience layer and the thickness of the intermediate layer, and the toner damage due to the stresses respectively generated between the layer-forming blade and the developing roller and between the photoconductor and the developing roller is further reduced by lowing the resilience and the hardness of the developing roller. As a result, an excessive increase in the toner conveyance amount during printing due to over-time use can be more appropriately suppressed.

Although the disposition of the intermediate layer in the developing roller of the present disclosure is optional, it is preferable to use an aqueous coating because an aqueous coating is environmentally friendly and renders it easier to form a low-hardness layer at low production costs. In addition, the intermediate layer, by using an aqueous coating containing no emulsifier, can also prevent image defects (white spots) caused by oil or the like, which may be added to the base layer to control the charging property of the developing roller, bleeding out of the base layer and contaminating the photoconductor.

The aqueous coating used in the intermediate layer is not particularly limited, and rubber or a resin known as a material for rollers and the like can be used. Examples of the resin include a urethane-modified acrylic resin, a urethane resin, an acrylic resin, an acrylic silicone resin, a polyamide resin, and a fluororesin. These may be used alone or in a combination of two or more. Suitable examples of the rubber-based aqueous coating include latex of natural rubber (NR), chloroprene rubber (CR), nitrile rubber (NBR), styrene-butadiene rubber (SBR) and the like. Suitable examples of the urethane resin-based aqueous coating include an ether-based or ester-based emulsion or dispersion. Suitable examples of the acrylic resin-based aqueous coating include an acrylic or acrylic styrene emulsion or the like. Suitable examples of the fluororesin-based aqueous coating include polytetrafluoroethylene or tetrafluoroethylene-perfluoroalkyl vinyl ether copolymer, tetrafluoroethylene-ethylene copolymer, polychlorotrifluoroethylene, chlorotrifluoroethylene-ethylene copolymer, tetrafluoroethylene-vinylidene fluoride copolymer, polyvinylidene fluoride, and polyvinyl fluoride. Among these, it is preferable to use an aqueous urethane resin for the intermediate layer of the developing roller of the present disclosure. This is because the aqueous urethane resin has more desirable characteristics such as high coatability and low hardness.

The aqueous coating forming the intermediate layer of the developing roller of the present disclosure may be added with a conductive agent to impart or adjust the conductivity (electric resistance), although it is not particularly limited. The conductive agent used in this case is not particularly limited, and various electronic conductive agents and various ionic conductive agents similar to those mentioned above and used for the base layer may be appropriately selected and used alone or in a combination of two or more. The blending amount of these conductive agents is appropriately selected according to the type of the composition, and usually it is adjusted so that the volume resistivity of the intermediate layer is $1\times10^4$ Ωcm or more and $1\times10^{12}$ Ωcm or less and preferably $1\times10^6$ Ωcm or move and $1\times10^8$ Ωcm or less. In addition, it is possible to further add additives other than the conductive agent such as a filler to the aqueous coating forming the intermediate layer.

Although the disposition of the intermediate layer in the developing roller of the present disclosure is optional, the thickness of the intermediate layer is preferably 20 μm or more and more preferably 30 μm or more, in order to obtain better other characteristics such as the balance with the required thickness of the low-resilience layer and the hardness of the developing roller. Further, it is preferably 150 μm or less and more preferably 120 μm or less. This is because, when the thickness of the intermediate layer is 20 μm or more, the balance of low hardness can be further enhanced; when the thickness of the intermediate layer is 150 μm or less, the effect of introducing a low-resilience layer can be more easily exhibited.

(Asker C Hardness and Thickness Value)

Asker C is one of the durometers (spring-type hardness tester) defined in SRIS0101 (Japan Rubber Association Standard), and is a measuring device for measuring hardness. A value measured by this measuring device is called Asker C hardness. Note that the thickness of the developing roller in the developing roller of the present disclosure refers to a distance from a surface of the shaft of the developing roller to a surface of the surface layer in the radial direction of the shaft. Because the developing roller of the present disclosure preferably has low hardness, the Asker C hardness of the developing roller is preferably low. However, the measured Asker C hardness of the developing roller is affected by the thickness of the developing roller (for example, the Asker C hardness of the developing roller decreases as the thickness of the developing roller increases), even if the composition of each layer formed on the outer peripheral portion of the shaft is the same. Therefore, if the Asker C hardness is used as it is, it is difficult to express the technical features and conditions that suitably bring out the effect of the developing roller of the present disclosure, which is determined by the balance between the Asker C hardness of the developing roller and the thickness of the developing roller. For this reason, in the present disclosure, the influence of the thickness of the developing roller on the Asker C hardness is taken into account, and as a correction, an Asker C hardness and thickness value of the developing roller is defined as in the following formula (1).

$$\text{Asker } C \text{ hardness and thickness value of developing roller} = \text{Asker } C \text{ hardness of developing roller} \times (\text{thickness of developing roller} + 6) \quad (1)$$

where the Asker C hardness of developing roller is a value measured under a load of 1 kg, and the thickness of developing roller is a distance from a surface of the shaft of the developing roller to a surface of the surface layer in the radial direction of the shaft (unit: mm).

When the Asker C hardness and thickness value of the developing roller of the present disclosure is 500 or less, the toner damage mainly caused by the stress generated between the photoconductor and the developing roller can be reduced. Although not particularly limited, the Asker C hardness and thickness value is preferably 400 or more. This is because, when the Asker C hardness and thickness value is 400 or more, it is possible to reduce the risk of occurrence of the problem that the restoration of deformed shape is poor.

(CIT Creep Rate)

The hardness, resilience, and plastic deformability of the developing roller of the present disclosure can be measured by, for example, a H100C hardness tester manufactured by Fischer. The hardness, resilience, and plastic deformability of the developing roller of the present disclosure can be expressed as a CIT creep rate (%) calculated according to the following formula (3), where with the hardness tester, an indenter is pressed to the surface of the developing roller to 30 μm ($h_1$) at a constant speed for 30 seconds, and an indentation depth ($h_2$) of the indenter when the indenter creeps for 30 seconds is measured.

$$CIT \text{ creep rate} = (h_2 - h_1)/h_1 \times 100 \quad (3)$$

The outline of the measurement with the hardness meter is as follows. An indenter is placed on the surface of the developing roller, and the pressing load of the indenter is gradually increased to a predetermined load to press the indenter into the surface of the developing roller. The constant load environment is held for a certain time and then the load of the indenter is decreased. In this way, the residual (creep value) of the deformation of the surface of the developing roller can be obtained. That is, in the case where the measured object is a completely elastic body, when the load is increased to press the indenter into the surface of the measured object and then the load of the indenter is decreased and removed, the surface of the measured object recovers to its original state. Therefore, the indenter returns to the original position, that is, a position where the indentation depth is 0. On the contrary, if the measured object is a completely plastic body, even if the indenter is pressed and then the load is removed in the same manner, the surface of the measured object remains in the state where the indenter is pressed in, and the indenter does not return to the original position. Utilizing this fact, the plastic deformation of the developing roller can be determined under standardized conditions, that is, arbitrary measurement conditions, from the difference in the positions at the start and end of the measurement.

The developing roller of the present disclosure preferably has a CIT creep rate of 5.0% or more. This is because, when the CIT creep amount of the developing roller is 5.0% or more, the developing roller has low hardness and low resilience that can further suppress the toner damage. In addition, the CIT creep rate of the developing roller is preferably 11% or less. This is because, when the CIT creep rate of the developing roller is 11% or less, the low hardness and low resilience of the developing roller can prevent a toner mass from entering a gap, which may be generated due to the plastic deformation of the developing roller, and prevent the toner from leaking from the gap, while sufficiently absorbing the stresses respectively from the layer-forming blade and the photoconductor to suppress the toner damage.

(How Toner Damage Occurs and how to Reduce Toner Damage)

The manner in which toner damage occurs and the manner in which toner damage is reduced will be described with reference to FIGS. 5 and 6, which is not to be construed to limit the scope of the present disclosure.

Figure 5:
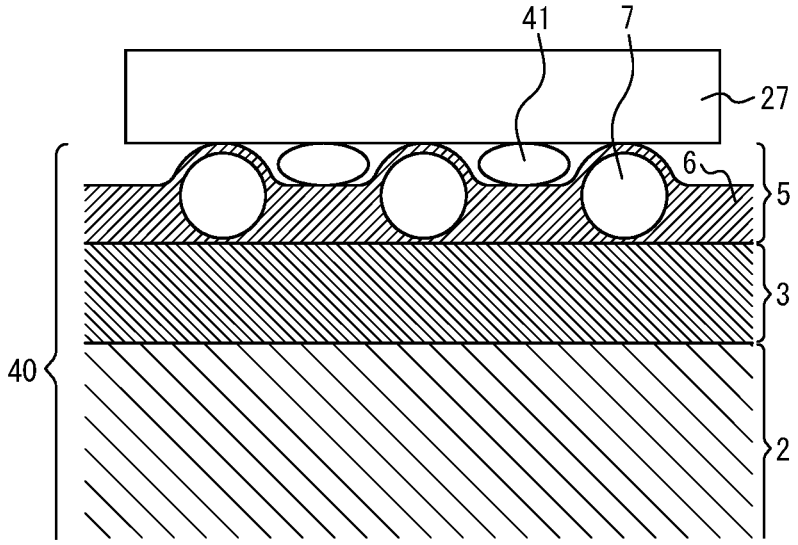
FIG. 5 schematically illustrates how toner damage occurs in a conventional developing roller due to a stress generated between a layer-forming blade and the developing roller.

FIG. 5 schematically illustrates how toner damage occurs in a conventional developing roller 40 due to a stress generated between a layer-forming blade 27 and the conventional developing roller 40. In the conventional developing roller 40 illustrated in FIG. 5, an intermediate layer 3 is disposed between a base layer 2 and a surface layer 5 (the surface layer 5 contains a surface layer-forming resin 6 and surface layer fine particles 7). In a "development" process of a series of image forming and printing processes, the layer-forming blade 27 and the conventional developing roller 40 come into contact with each other, and a stress is generated therebetween. Due to the stress, toner on a surface of the surface layer 5 of the conventional developing roller 40 turns into toner 41 which has been greatly damaged. As a result, in the conventional developing roller 40, the toner conveyance amount during printing increases excessively due to over-time use.

Figure 6:
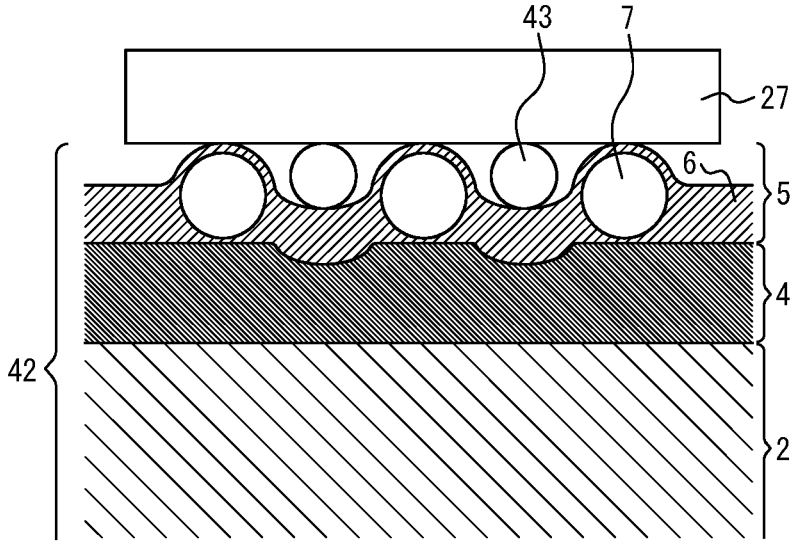
FIG. 6 schematically illustrates how toner damage due to a stress generated between a layer-forming blade and a developing roller is reduced in a developing roller having low resilience and low hardness, which is an embodiment of the present disclosure; and, Each reference signs indicate the following.

On the other hand, FIG. 6 schematically illustrates how the developing roller 42, which is an embodiment of the present disclosure, reduces toner damage caused by a stress generated between a layer-forming blade 27 and the developing roller 42 of the present disclosure. In the developing roller 42 illustrated in FIG. 6, which is an embodiment of the present disclosure, a low-resilience layer 4 is disposed between a base layer 2 and a surface layer 5 (the surface layer 5 contains a surface layer-forming resin 6 and surface layer fine particles 7). In addition, the loss tangent tan δ value of the low-resilience layer 4 is larger than the loss tangent tan δ value of any of the base layer 2 and the surface layer 5, and the Asker C hardness and thickness value of the developing roller 42 of the present disclosure is 500 or less. In a "development" process of a series of image forming and printing processes, the layer-forming blade 27 and the developing roller 42 of the present disclosure come into contact with each other. Although a stress may be generated between the layer-forming blade 27 and the developing roller 42, the developing roller 42 of the present disclosure, as described above, is introduced with a low-resilience layer 4 and has an Asker C hardness and thickness value of 500 or less. Therefore, it is considered that the stress is absorbed and dispersed. Then, the toner on the surface of the surface layer 5 of the developing roller 42 of the present disclosure turns into toner 43 in which toner damage has been suppressed. As a result, the developing roller 42 of the present disclosure can suppress an excessive increase in the toner conveyance amount during printing due to over-time use.

(Image Forming Apparatus)

Figure 1:
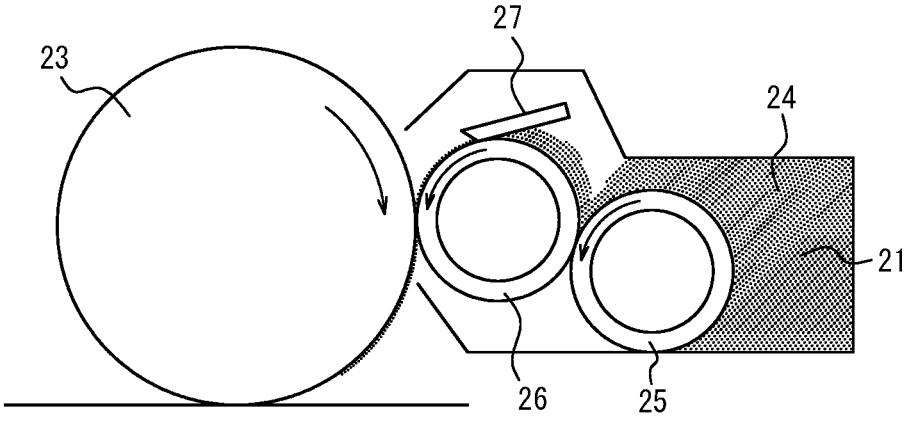
FIG. 1 is a partial cross-sectional view schematically illustrating an example of an image forming apparatus.

The developing roller of the present disclosure can be used in the same manner as a conventional developing roller in the series of image forming and printing processes with an image forming apparatus such as a conventional copying machine or laser beam printer illustrated in FIG. 1. The developing roller of the present disclosure is a developing roller in which toner damage caused by stresses respectively generated between a layer-forming blade and the developing roller and between a photoconductor and the developing roller is reduced because of low resilience and low hardness, and an image forming apparatus equipped with the developing roller has good image forming and printing quality, and the good state continues for a longer period of time.

Examples

The following describes the present disclosure in more detail with reference to Examples, where the following Examples are not to be construed to limit the scope of the present disclosure.

(Preparation of Test Developing Roller)

<Formation of Base Layer>

A urethane prepolymer in which acetylene black was dispersed was prepared by mixing 100 parts by mass of a urethane prepolymer, which was synthesized from tolylene diisocyanate (TDI) and polyether polyol, and 2 parts by mass of acetylene black, and the urethane prepolymer in which acetylene black was dispersed was used as Component A. On the other hand, a mixture was prepared by mixing 30 parts by mass of polyether polyol and 0.1 parts by mass of sodium perchlorate ($NaClO_4$) while heating them at 70° C., and further mixing them with 4.5 parts by mass of polyether-modified silicone oil (foam stabilizer) and 0.2 parts by mass of dibutyltin dilaurate (catalyst), and the mixture was used as Component B. Subsequently, the Components A and B were foamed with the mechanical floss method, then injected into a cylindrical mold in which a cored bar to be a shaft had been set, and a base layer formed of polyurethane foam was formed on an outer peripheral portion of the shaft by RIM molding.

The following two types of base layers having different densities were respectively formed by adjusting the foaming process during the formation of the base layer.

Conventional base layer: 0.75 g/cm$^3$

Low-hardness base layer: 0.5 g/cm$^3$

<Formation of Intermediate Layer>

An aqueous coating composition was prepared by blending 100 parts by mass of a urethane emulsion (E4800, DKS Co. Ltd.), in which the amount of urethane bonds was reduced in its composition to obtain a low modulus, and 4 parts by mass of lithium bis (trifluoromethanesulfonyl) imide (EF-N115, Mitsubishi Materials Electronic Chemicals Co., Ltd.) as a conductive agent. The aqueous coating composition was dip-coated on the base layer formed on the outer peripheral portion of the shaft so as to have a predetermined thickness. Then, the aqueous coating composition was dried at room temperature for 30 minutes and at 110° C. for 20 minutes to form an intermediate layer. Note that the intermediate layer of this composition was disposed between the base layer and the surface layer of a conventional developing roller to reduce the hardness of the developing roller, so that the intermediate layer will be referred to as a conventional intermediate layer.

<Formation of Low-Resilience Layer>

With respect to a developing roller having a low-resilience layer disposed between an intermediate layer and a surface layer, an aqueous coating composition was prepared by blending 100 parts by mass of an anionic high-molecular weight polyurethane dispersion (Dispercoll U42, Sumika Bayer Urethane Co., Ltd.) and 4 parts by mass of lithium bis (trifluoromethanesulfonyl) imide (EF-N115, Mitsubishi Materials Electronic Chemicals Co., Ltd.) as a conductive agent. The coating was dip-coated on the formed intermediate layer so as to have a predetermined thickness. The coating was dried at room temperature for 30 minutes and at 110° C. for 20 minutes to form a low-resilience layer.

<Formation of Surface Layer>

The following two types of surface layers with different hardness were formed respectively as the surface layer.

[Conventional Surface Layer]

A coating composition was prepared by adding urethane particles (ART PEARL JB800T, Negami chemical industrial co., ltd), which had been adjusted to have the same roughness, in the range of 15 parts by mass to 35 parts by mass as surface layer fine particles and 5 parts by mass of a silicon-based block copolymer (MODIPER FS710, NOF CORPORATION) to a surface layer-forming resin component (Tg: −8° C.) in which 50 parts by mass of polyisocyanate (EXCELHARDENER HX, ASIA INDUSTRY CO., LTD.) was blended with 100 parts by mass of polyol (PLACCEL 220EB, Daicel Corporation), and further adding carbon black to adjust the resistance. The obtained coating composition was applied onto the formed intermediate layer or low-resilience layer so as to have a predetermined thickness, and the coating composition was heated at 115° C. for 60 minutes for curing to form a conventional surface layer.

[Low-Hardness Surface Layer]

A prepolymer was obtained by reacting 2.5 parts by mass of hexamethylene diisocyanate with 100 parts by mass of polyol (PLACCEL 220EB, Daicel Corporation). A coating composition was prepared by adding urethane particles (ART PEARL JB800T, Negami chemical industrial co., ltd), which had been adjusted to have the same roughness, in the range of 15 parts by mass to 35 parts by mass as surface layer fine particles and 5 parts by mass of a silicon-based block copolymer (MODIPER FS710, NOF CORPORATION) to a surface layer-forming resin component (Tg: −17° C.) in which 25 parts by mass of polyisocyanate (EXCELHARDENER HX, ASIA INDUSTRY CO., LTD.) was blended with 100 parts by mass of the prepolymer, and further adding carbon black to adjust the resistance. The obtained coating composition was applied onto the formed intermediate layer or low-resilience layer so as to have a predetermined thickness, and the coating composition was heated at 115° C. for 60 minutes for curing to form a low-hardness surface layer.

(Measurement of Loss Tangent Tan δ Value)

The loss tangent tan δ value of each layer of the test developing roller thus prepared was measured with a dynamic viscoelasticity automatic measuring device (RHEOVIBRON DDV-01GP, A&D Company, Limited) under the conditions of a temperature of 23° C., an amplitude of ±20 μm, and a frequency of 6 Hz (frequency calculated from the rotation speed of the developing roller inside a printer used in the measurement).

(Measurement of CIT Creep Rate of Developing Roller)

The CIT creep rate of each test developing roller thus prepared was calculated by substituting the numerical values of $h_1$ and $h_2$ into the following formula (3), where with a H100C hardness tester manufactured by Fischer, an indenter of the hardness tester was pressed to the surface of each test developing roller to 30 μm ($h_1$) at a constant speed for 30 seconds, and an indentation depth ($h_2$) of the indenter when the indenter crept for 30 seconds was measured.

$$CIT \text{ creep rate}=(h_2-h_1)/h_1\times 100 \quad (3)$$

(Measurement of Asker C Hardness of Developing Roller)

The Asker C hardness of each test developing roller thus prepared was measured using an automatic rubber hardness tester P1-C sensor (KOBUNSHI KEIKI CO., LTD.) under a load of 1 kg. In addition, the thickness of each test developing roller was obtained by respectively measuring the outer diameter of the developing roller and the outer diameter of the shaft of the developing roller using a laser dimension measuring instrument, and substituting them into the following formula (4) (unit: mm).

$$\text{Thickness of developing roller}=((\text{outer diameter of developing roller})-(\text{outer diameter of shaft of developing roller}))/2 \quad (4)$$

Then, the Asker C hardness and thickness value of the developing roller was calculated from the measured and calculated Asker C hardness value of each test developing roller and the thickness value (unit: mm) of each test developing roller using the following formula (1).

$$\text{Asker } C \text{ hardness and thickness value of developing roller}=\text{Asker } C \text{ hardness of developing roller}\times(\text{thickness of developing roller}+6) \quad (1)$$

(Measurement of Toner Conveyance Amount of Developing Roller)

Each test developing roller was installed in a commercially available printer (LBP651C manufactured by Canon Inc.) in an environment of a temperature of 23° C. and humidity of 53%, and then the test developing roller was idled in the printer to form a uniform thin layer of toner on the surface of the developing roller. The thin layer of toner was absorbed and introduced into a Faraday gauge, and the weight of the absorbed toner was measured. At the same time, the area of the surface of the developing roller in which the toner had been removed by absorption was measured, and the toner weight per unit area was calculated to obtain the toner conveyance amount. Then, based on the toner conveyance amount of each test developing roller after printing several sheets, a toner conveyance amount change score during printing due to over-time use was defined as follows: when the increase in the toner conveyance amount of the test developing roller after printing 6K sheets was less than 0.03 mg/cm$^2$, it was excellent; when the increase was 0.03 mg/cm$^2$ or more and less than 0.06 mg/cm$^2$, it was good; when the increase was 0.06 mg/cm$^2$ or more, it was poor.

(Measurement Result)

The following table lists the measured values of the loss tangent tan δ of each layer used in the test developing roller.

TABLE 1

| Layer | Loss tangent tanδ value |
|---|---|
| Conventional base layer | 0.12 |
| Low-hardness base layer | 0.13 |
| Conventional intermediate layer | 0.21 |
| Low-resilience layer | 0.58 |
| Conventional surface layer | 0.26 |
| Low-hardness surface layer | 0.17 |

It was confirmed that the loss tangent tan δ value of the low-resilience layer used in the test developing roller was larger than the loss tangent tan δ value of any of the conventional base layer, low-hardness base layer, conventional intermediate layer, conventional surface layer, and low-hardness surface layer.

The structure of the disposed layers, CIT creep rate, Asker C hardness and thickness value, and toner conveyance amount change score of each test developing roller are listed in the following table.

TABLE 2

| | Layer structure of developing roller | | | | Measured and calculated value/Evaluation score | | |
|---|---|---|---|---|---|---|---|
| | Base layer | Conventional intermediate layer | Low-resilience layer | Surface layer | CIT creep rate (%) | Asker C hardness and thickness value | Toner conveyance amount change score |
| Comparative Example 1 | Conventional | 120 | — | Conventional | 2.8 | 530 | Poor |
| Comparative Example 2 | Conventional | 60 | Introduced (60) | Conventional | 5.4 | 530 | Poor |
| Comparative Example 3 | Low-hardness | 120 | — | Conventional | 2.0 | 480 | Poor |
| Example 1 | Low-hardness | 60 | Introduced (60) | Conventional | 5.6 | 480 | Good |
| Example 2 | Low-hardness | 30 | Introduced (90) | Conventional | 10.2 | 480 | Excellent |
| Example 3 | Low-hardness | 60 | Introduced (60) | Low-hardness | 8.0 | 480 | Excellent |

Where in the row of conventional intermediate layer, the numerical value indicates the thickness of the conventional intermediate layer (unit: μm);

in the row of low-resilience layer: "–" means that no low-resilience layer was disposed between the conventional intermediate layer and the surface layer;

"introduced" means that a low-resilience layer was disposed between the conventional intermediate layer and the surface layer; and the numerical value in ( ) indicates the thickness (unit: μm).

In any of the examples, the thickness of the conventional intermediate layer and the low-resilience layer combined was set to be constant (120 μm).

Examples 1 to 3 relating to the developing roller of the present disclosure, in which a low-resilience layer having a loss tangent tan δ value larger than that of any of the base layer and the surface layer was disposed between the base layer and the surface layer, and the Asker C hardness and thickness value was 500 or less, had good results in the toner conveyance amount change score, which were "good" or "excellent".

INDUSTRIAL APPLICABILITY

The present disclosure provides a developing roller in which the resilience and the hardness of the developing roller are lowered to reduce toner damage caused by stresses respectively generated between a layer-forming blade and the developing roller and between a photoconductor and the developing roller, and as a result, an excessive increase in the toner conveyance amount during printing due to over-time use is suppressed. The developing roller provided by the present disclosure can be used in an image forming apparatus such as a copying machine or a laser beam printer, where the image forming apparatus has good image forming and printing quality and the good state continues for a longer period of time.

The invention claimed is:

1. A developing roller comprising a shaft, and a base layer and a surface layer sequentially formed on an outer peripheral portion of the shaft in a radial direction, wherein 1) a low-resilience layer is disposed between the base layer and the surface layer, 2) the low-resilience layer has a loss tangent tan δ value that is larger than a loss tangent tan δ value of any of the base layer and the surface layer when measured under conditions of a temperature of 23° C., an amplitude of ±20 μm, and a frequency of 6 Hz, and 3) the developing roller has an Asker C hardness and thickness value of 500 or less, which is defined by the following formula (1):

$$\text{Asker } C \text{ hardness and thickness value of developing roller} = \text{Asker } C \text{ hardness of developing roller} \times (\text{thickness of developing roller} + 6) \quad (1)$$

where the Asker C hardness of developing roller is a value measured under a load of 1 kg, and the thickness of developing roller is a distance from a surface of the shaft of the developing roller to a surface of the surface layer in the radial direction of the shaft in unit of mm.

2. The developing roller according to claim 1, wherein the developing roller has a CIT creep rate of 5.0% or more.

3. The developing roller according to claim 1, wherein the low-resilience layer contains an aqueous urethane resin.

4. The developing roller according to claim 1, wherein the surface layer contains urethane resin particles.

5. The developing roller according to claim 1, wherein the low-resilience layer has a thickness of 40 μm or more.

6. An image forming apparatus using the developing roller according to claim 1.

7. The developing roller according to claim 2, wherein the low-resilience layer contains an aqueous urethane resin.

8. The developing roller according to claim 2, wherein the surface layer contains urethane resin particles.

9. The developing roller according to claim 2, wherein the low-resilience layer has a thickness of 40 μm or more.

10. An image forming apparatus using the developing roller according to claim 2.

11. The developing roller according to claim 3, wherein the surface layer contains urethane resin particles.

12. The developing roller according to claim 3, wherein the low-resilience layer has a thickness of 40 μm or more.

13. An image forming apparatus using the developing roller according to claim 3.

14. The developing roller according to claim 4, wherein the low-resilience layer has a thickness of 40 μm or more.

15. An image forming apparatus using the developing roller according to claim 4.

16. An image forming apparatus using the developing roller according to claim 5.

17. The developing roller according to claim 7, wherein the surface layer contains urethane resin particles.

18. The developing roller according to claim 7, wherein the low-resilience layer has a thickness of 40 μm or more.

19. An image forming apparatus using the developing roller according to claim 7.

20. The developing roller according to claim 8, wherein the low-resilience layer has a thickness of 40 μm or more.

* * * * *